US005711758A

United States Patent [19]

Tseng

[11] Patent Number: 5,711,758

[45] Date of Patent: Jan. 27, 1998

[54] HANDY BODY MASSAGER

[76] Inventor: James Tseng, No. 322, Chang Chun Road, Taoyuan City, Taiwan

[21] Appl. No.: 671,966

[22] Filed: Jun. 28, 1996

[51] Int. Cl.[6] ..... A61H 15/00

[52] U.S. Cl. ..... 601/127; 601/125; 601/126; 601/70; 601/72; 601/112; 601/113

[58] Field of Search ..... 601/46, 67, 69, 601/70, 72, 112, 113, 118, 119, 120, 122, 123, 125, 126, 127, 134, 135

[56] References Cited

U.S. PATENT DOCUMENTS

| | | | |
|---|---|---|---|
| 1,710,051 | 4/1929 | Giacopazzi | 601/127 |
| 4,716,891 | 1/1988 | Yorgan | 601/127 |
| 4,782,823 | 11/1988 | Yamasaki | 601/127 |
| 5,554,102 | 9/1996 | Chiou | 601/119 |

FOREIGN PATENT DOCUMENTS

| | | | |
|---|---|---|---|
| 366628 B | 2/1963 | Switzerland | 601/127 |
| 2246298 | 1/1992 | United Kingdom | 601/127 |

*Primary Examiner*—Robert A. Hafer
*Assistant Examiner*—Benjamin K. Koo
*Attorney, Agent, or Firm*—Morton J. Rosenberg; David I. Klein; Jun Y. Lee

[57] ABSTRACT

A handy body massager including a casing defining a substantially U-shaped handle, a barrel supported on rollers in two roller holders between two opposite ends of the handle and having massaging rollers supported on roller racks around the periphery and a fixed connecting block on the inside, a motor fixedly mounted in a motor chamber at one end of the handle, a reducing gear coupled to the motor shaft of the motor and having an output shaft fixedly connected to a connecting block of the barrel and adapted for turning the barrel upon the operation of the motor, a massaging disk coupled to the output shaft of the reduction gear outside the casing and having a plurality of massaging rollers turned about a respective wheel axle at an outer side for massaging.

2 Claims, 4 Drawing Sheets

HANDY BODY MASSAGER

BACKGROUND OF THE INVENTION

The present invention relates to a handy body massager which comprises a motor fixedly secured to the casing thereof and controlled to turn a barrel, which has massaging rollers on the outside, through a reducing gear.

Various handy massaging apparatus have been disclosed for massaging the body, and have appeared on the market. These massaging apparatus commonly use a motor to turn a horizontal barrel with massaging rollers. Because the barrel is fixedly secured to the shell of the motor and the motor shaft of the motor is fixedly secured to the casing of the massaging apparatus, the barrel and the motor are simultaneously turned about the motor shaft when the motor is started. Because the motor shaft of the motor is fixedly secured to the casing of the massaging apparatus, no additional massaging accessories can be attached to motor shaft of the motor outside the casing of the massaging apparatus and turned by it. Because the motor is turned about the motor shaft, the bearing elements between the shell of the motor and the motor shaft and the internal winding and magnet of the motor wear quickly with use.

SUMMARY OF THE INVENTION

The present invention has been accomplished to provide a handy body massager which eliminates the aforesaid problems. According to one embodiment of the present invention, the handy body massager including a casing defining a substantially U-shaped handle, a barrel supported on rollers in two roller holders between two opposite ends of the handle and having massaging rollers supported on roller racks around the periphery and a fixed connecting block on the inside, a motor fixedly mounted in a motor chamber at one end of the handle, a reducing gear coupled to the motor shaft of the motor and having an output shaft fixedly connected to a connecting block of the barrel and adapted for turning the barrel upon the operation of the motor, a massaging disk coupled to the output shaft of the reduction gear outside the casing and having a plurality of massaging rollers turned about a respective wheel axle at an outer side for massaging.

DETAILED DESCRIPTION OF THE PREFERRED EMBODIMENT

Figure 1:
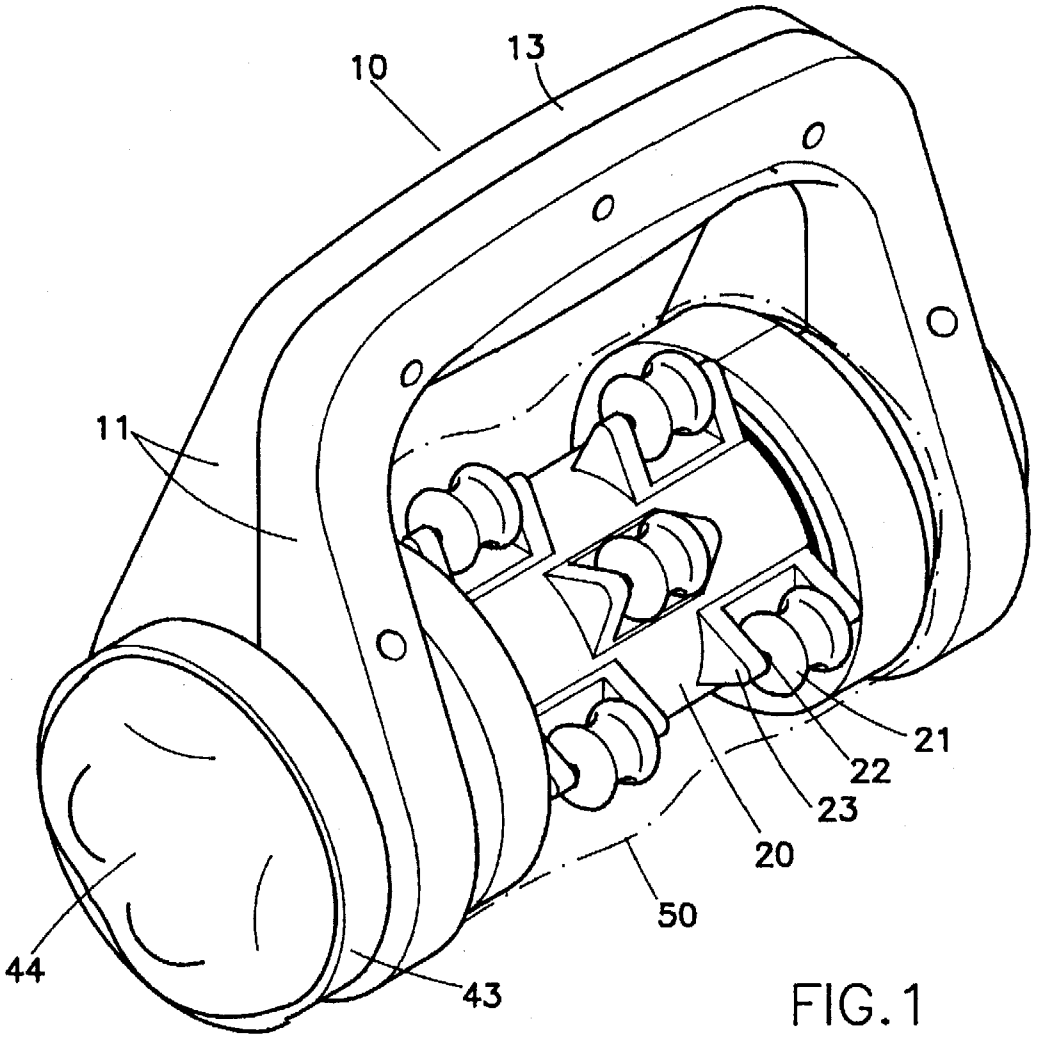
FIG. 1 is an elevational view of a handy body massager according to a first embodiment of the present invention.
Figure 2:
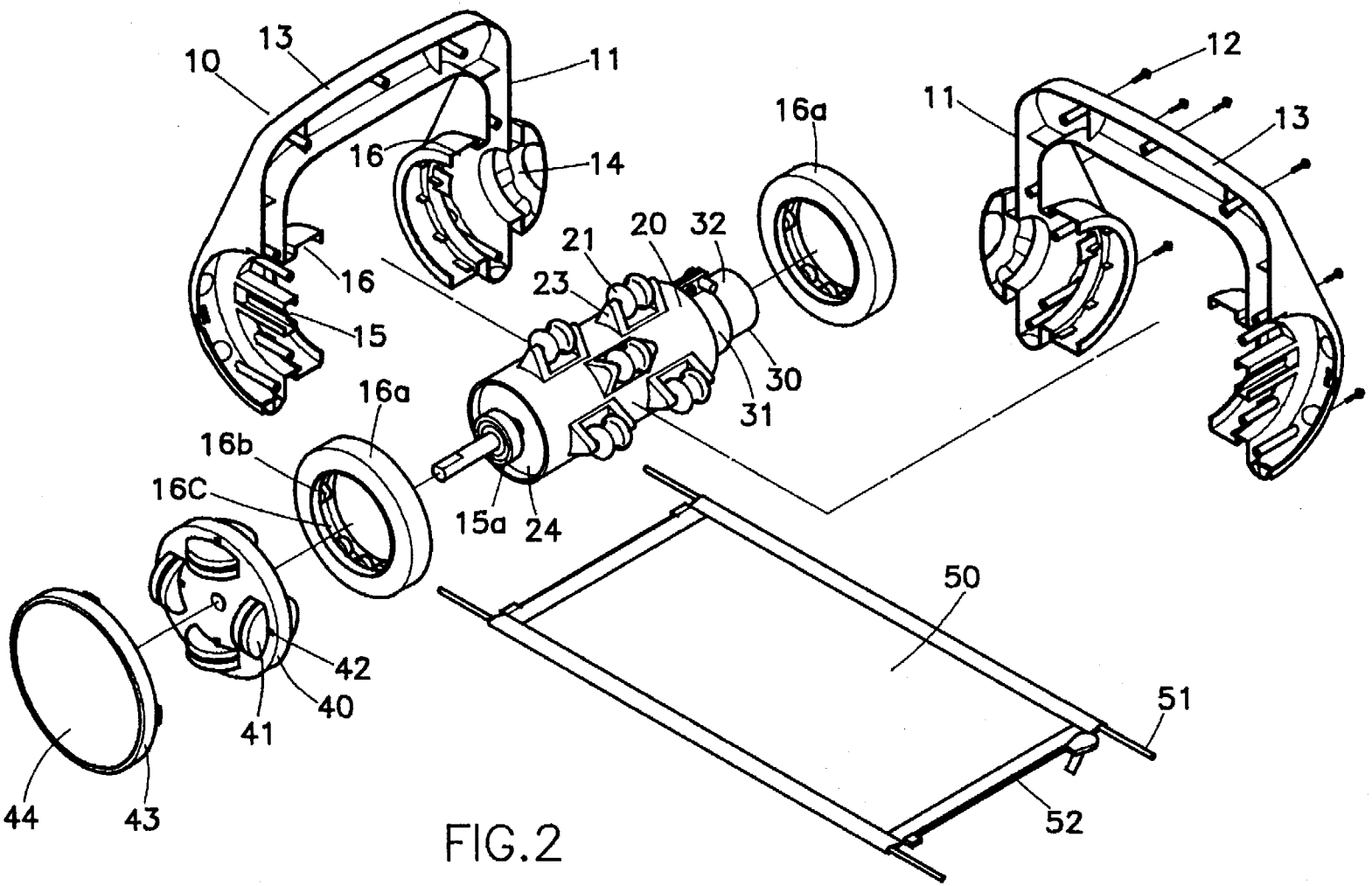
FIG. 2 is an exploded view of the handy body massager shown in FIG. 1.

Referring to Figures from 1 to 3, a handy body massager in accordance with the present invention is generally comprised of a casing 10, a barrel 20, and a motor 30.

The casing 10 is comprised of two symmetrical halves 11 connected together by screws 12, having a motor chamber 14 at one end, a bearing block 15 at an opposite end, a substantially U-shaped handle 13 connected between the motor chamber 14 and the bearing block 15, two holder mounts 16 respectively connected to the motor chamber 14 and the bearing block 15 at an inner side, an axle bearing **15*a* mounted in the bearing block 15, two annular roller holders 16*a* respectively mounted in the holder mount 16. Each of the annular roller holders 16*a* comprises an inside annular groove 16*c* around the inner diameter, and a plurality of rollers 16*b* pivotably mounted in the inside annular groove 16*c*** and equiangularly spaced from one another and partially protruding over the inner diameter.

The barrel 20 is mounted between the wheel holders 16 and supported on the rollers **16*b* of the annular roller holders 16*a*, comprising a plurality of roller racks 23 spaced around the periphery, a plurality of wheel axles 22 respectively mounted in the roller racks 23 in parallel to the longitudinal central axis of the barrel 20, a plurality of massaging rollers 21 respectively turned about the wheel axles 22, and a connecting block 24** fixedly mounted on the inside near one end.

The motor 30 is mounted in the motor chamber 14 of the casing 10. The shell 32 of the motor 30 is fixed to the motor chamber 14 of the casing 10 by a mounting frame 31. A reduction gear 33 is fixedly secured to the shell 32 of the motor 30 and coupled to the motor shaft (not shown) of the motor 30, having an output shaft 34 fixedly connected to the connecting block 24 and extending out of a hole (not shown) in the connecting block 34 and then mounted in the axle bearing **15*a*. When the motor 30 is started, the connecting block 24 is turned by the output shaft 34 of the reduction gear 23, thereby causing the barrel 20 to be rotated within the annular roller holders 16*a* relative to the motor 30. A massaging disk 40 is coupled to the output shaft 34, having a plurality of massaging rollers 41 turned about a respective wheel axle 42. A soft covering 44 is fixedly secured to the massaging disk 40 by a mounting frame 43, and covered over the massaging rollers 41. The soft covering 44 is preferably made from fabric. When the barrel 20 is turned by the output shaft 34 of the reduction gear 33, the massaging disk 40** is synchronously rotated.

After the installation of the barrel 20 and the motor 30 in the casing 10, the two symmetrical halves 11 of the casing 10 are fixedly secured together by screws 12, and then a soft covering 50 is fastened to the casing 10 and covered over the massaging rollers 21 of the barrel 20. The soft covering 50 is preferably made from fabric, and equipped with flexible wire rods 51 and zip fasteners 52 for fastening.

Figure 3:
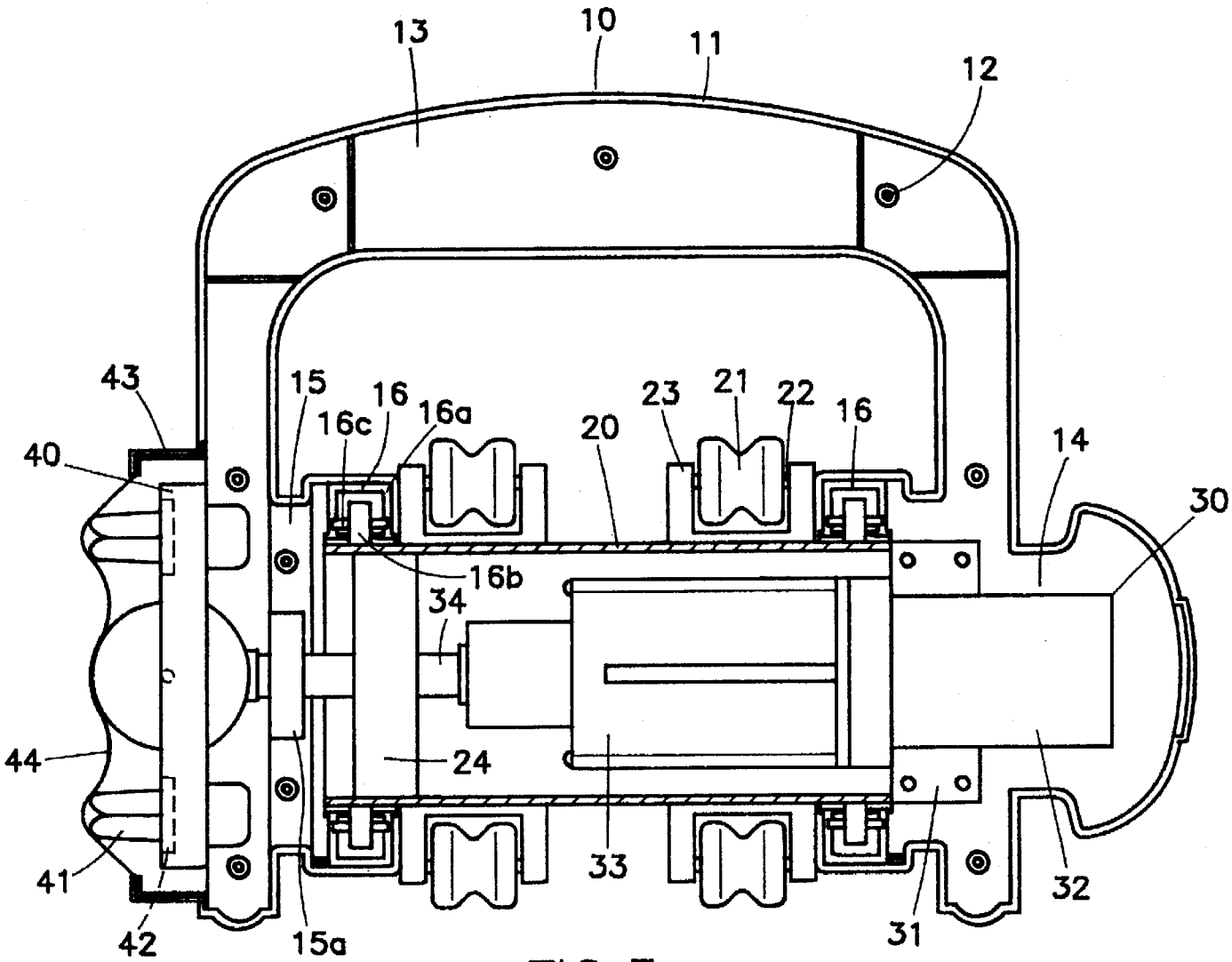
FIG. 3 is a sectional plain view of the handy body massager shown in FIG. 1.

Referring to FIG. 3 again, when the motor 30 is started, the barrel 20 and the massaging disk 40 are synchronously rotated, and therefore the user can hold the handle 13 and attach the massaging rollers 21,41 to the body to massage the desired part of the body. Because the barrel 20 is coupled to the motor 30 through the reduction gear 33 and the shell 32 of the motor 30 is fixedly secured to the casing 10, the motor 30 is immovable when it is started to turn the barrel 20. This arrangement prevents a damage to the bearing members between the shell and motor shaft of the motor and the internal members of the motor, for example, the winding and the magnet.

Figure 4:
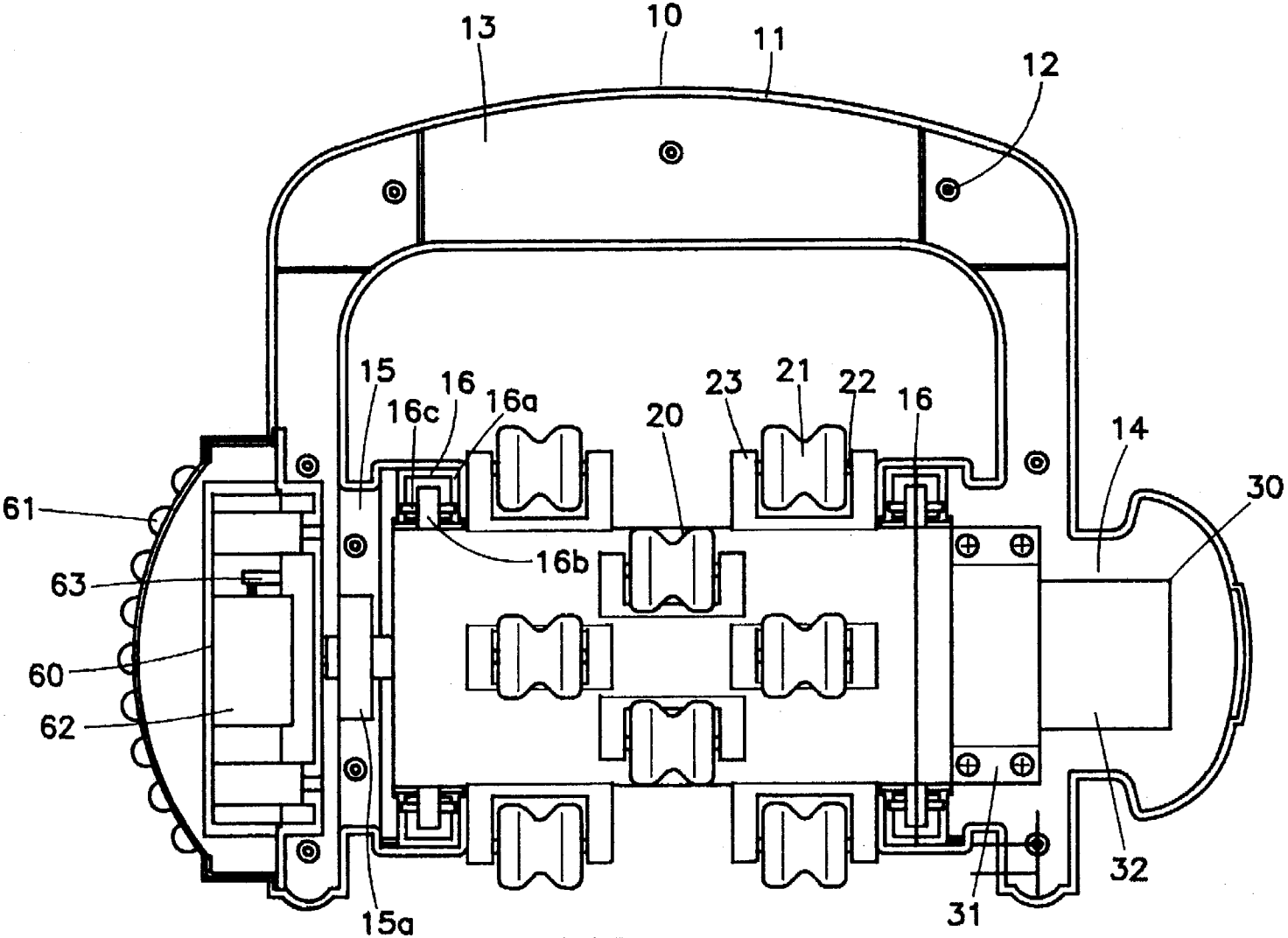
FIG. 4 is a sectional plain view of a handy body massager according to a second embodiment of the present invention.

FIG. 4 shows an alternate form of the present invention, in which a vibrating disk 60 is installed to replace the aforesaid massaging disk 40. The vibrating disk 60 comprises a plurality of raised portions 61 over the outside wall thereof, and is vibrated by a motor 62 through a cam 63. When the motor 62 is started to turn the cam 63, the vibrating disk 60 is forced to vibrate by the cam 63 for massaging the body.

It is to be understood that the drawings are designed for purposes of illustration only, and are not intended as a definition of the limits and scope of the invention disclosed.

What the invention claimed is:

1. A handy body massager comprising:

a casing comprised of two symmetrical halves connected together by screws, having a motor chamber at one end, a bearing block at an opposite end, a substantially U-shaped handle connected between said motor chamber and the bearing block, two holder mounts respectively connected to said motor chamber and said bearing block at an inner side, an axle bearing mounted in said bearing block, two annular roller holders respectively mounted in said holder mounts, each of said annular roller holders comprising an inner diameter, an inside annular groove around said inner diameter, and a plurality of rollers pivotably mounted in said inside annular groove and equiangularly spaced from one another;

a barrel mounted between said wheel holders and supported on the rollers of said annular wheels, said barrel comprising a plurality of roller racks spaced around the periphery, a plurality of wheel axles respectively mounted in said roller racks in parallel to the longitudinal central axis of said barrel, a plurality of massaging rollers respectively turned about said wheel axles, a connecting block fixedly mounted on the inside near one end, and a soft covering covered over the massaging rollers of said barrel;

a motor mounted in said motor chamber of said casing, said motor having a shell fixedly secured to said casing by a mounting frame, and a motor shaft coupled to a reduction gear;

a reduction gear fixedly secured to the shell of said motor and coupled to the motor shaft of said motor, having an output shaft fixedly connected to the connecting block of said barrel; and a massaging disk coupled to the output shaft of said reduction gear and disposed outside said casing, said massaging disk having a plurality of massaging rollers turned about a respective wheel axle at an outer side, and a soft covering covered over the massaging rollers of said massaging disk.

2. A handy body massager comprising:

a casing comprised of two symmetrical halves connected together by screws, having a motor chamber at one end, a bearing block at an opposite end, a substantially U-shaped handle connected between said motor chamber and the bearing block, two wheel holders respectively connected to said motor chamber and said bearing block at an inner side, an axle bearing mounted in said bearing block, two annular wheels respectively mounted in said wheel holder, each of said annular wheels comprising an inner diameter, an inside annular groove around said inner diameter, and a plurality of rollers pivotably mounted in said inside annular groove and equiangularly spaced from one another;

a barrel mounted between said wheel holders and supported on the rollers of said annular wheels, said barrel comprising a plurality of roller racks spaced around the periphery, a plurality of wheel axles respectively mounted in said roller racks in parallel to the longitudinal central axis of said barrel, a plurality of massaging rollers respectively turned about said wheel axles, a connecting block fixedly mounted on the inside near one end, and a soft covering covered over the massaging rollers of said barrel;

a first motor mounted in said motor chamber of said casing, said first motor having a shell fixedly secured to said casing by a mounting frame, and a motor shaft coupled to a reduction gear;

a reduction gear fixedly secured to the shell of said first motor and coupled to the motor shaft of said first motor, having an output shaft fixedly connected to the connecting block of said barrel;

a vibrating disk coupled to said casing at one end and driven to vibrate, said vibrating disk comprising a plurality of raised portions over an outer wall thereof for massaging;

a second motor having a cam coupled to an output shaft thereof and turned to vibrate said vibrating disk.

* * * * *